US006599376B2

(12) United States Patent
Morikawa et al.

(10) Patent No.: US 6,599,376 B2
(45) Date of Patent: Jul. 29, 2003

(54) FE-CR SOFT MAGNETIC MATERIAL AND A METHOD OF MANUFACTURING THEREOF

(75) Inventors: Hiroshi Morikawa, Shin-Nanyo (JP); Tomoharu Shigetomi, Shin-Nanyo (JP); Ryoji Hirota, Tokyo (JP); Takashi Yamauchi, Shin-Nanyo (JP)

(73) Assignee: Nisshin Steel Co., Ltd. (JP)

( * ) Notice: Subject to any disclaimer, the term of this patent is extended or adjusted under 35 U.S.C. 154(b) by 0 days.

(21) Appl. No.: 09/997,386

(22) Filed: Nov. 29, 2001

(65) Prior Publication Data

US 2002/0104586 A1 Aug. 8, 2002

(30) Foreign Application Priority Data

Nov. 30, 2000 (JP) ..... 2000-365793
Jun. 7, 2001 (JP) ..... 2001-172892

(51) Int. Cl.[7] ..... H01F 1/147
(52) U.S. Cl. ..... 148/306; 420/34; 420/104
(58) Field of Search ..... 148/306; 420/34, 420/104

(56) References Cited

U.S. PATENT DOCUMENTS 5,091,024 A * 2/1992 DeBold et al. ..... 148/306
6,162,306 A * 12/2000 Takajo et al. ..... 148/309

FOREIGN PATENT DOCUMENTS

JP 59-190349 * 10/1984

* cited by examiner

*Primary Examiner*—John Sheehan
(74) *Attorney, Agent, or Firm*—Webb Ziesenheim Logsdon Orkin & Hanson P.C.

(57) ABSTRACT

A Fe–Cr soft magnetic material has electric resistivity not less than 50 $\mu\Omega\cdot$cm and a metallurgical structure occupied by a ferrite phase at a surface ratio of 95% or more. A number of fine precipitates of 1 $\mu$m or less in particle size is controlled at a ratio not more than $6\times10^5/mm^2$. The Fe–Cr alloy has the composition (expressed in mass or weight %) of C up to 0.05%, N up to 0.05%, Si up to 3.0%, Mn up to 1.0%, P up to 0.04%, S up to 1.0%, 5.0–20.0% Cr, Al up to 4.0%, 0–3% Mo, 0–0.5% Ti and the balance being essentially Fe under the conditions of (1) and (2). The Fe–Cr soft magnetic material is useful as a core, a yoke or the like installed in various types of magnetic sensors such as electric power steering, fuel injection systems for vehicles and A.C. magnetic circuits of solenoid valves, due to production of high magnetic induction in a high-frequency low-magnetic field:

$$4.3\times\%Cr+19.1\times\%Si+15.1\times\%Al+2.5\times\%Mo\geqq40.2 \quad (1)$$

$$64\times\%Si+35\times\%Cr+480\times\%Ti+25\times\%Mo+490\times\%Al\geqq221\times\%C+247\times\%N+40\times\%Mn+80\times\%Ni+460 \quad (2).$$

2 Claims, 3 Drawing Sheets

FE-CR SOFT MAGNETIC MATERIAL AND A METHOD OF MANUFACTURING THEREOF

BACKGROUND OF THE INVENTION

The present invention relates to a soft magnetic material useful as a core, a yoke or the like installed in various types of magnetic sensors such as electric power steering, fuel injection systems for vehicles and A.C magnetic circuits such as solenoid valves.

An A.C. magnetic circuit is built into an electromagnetic induction sensor, e.g. a differential coil magnetic sensor or a flow sensor, or a mechanical quantity sensor, e.g. a magnetostrictive torque sensor or a phase-differentiated torque sensor. Another type of a sensor, which uses an exciting coil as a detection coil, is already known. A core and a yoke as parts of such the A.C. magnetic circuit are made of soft magnetic material such as pure iron, Si steel, soft ferrite or permalloy.

Displacement of an object or a torque is detected as a slight change in impedance or voltage of the detection coil originated in displacement of the object by applying A.C. to the exciting coil so as to produce an alternating field.

The demand for improved measurement accuracy becomes stronger and stronger along with the development of magnetic sensors. Since a reduction of noises during detection of output voltage is necessary in order to improve measurement accuracy, a high-frequency (e.g. 100 Hz–5 kHz) electric current with a sine or rectangular wave is applied to an exciting coil.

However, eddy current loss of electromagnetic soft iron (SUYP), which has been commonly used as soft magnetic material, increases in proportion to a frequency increase of the applied magnetic field, resulting in decrease of magnetic induction necessary for a sufficient output voltage. Si steel is advantageous in less eddy current loss due to its high electric resistivity compared with electromagnetic soft ion, but Si content necessarily increases in order to suppress reduction of magnetic induction in an alternating field with frequency not less than 1 kHz. Although an increase of Si content effectively enlarges the electric resistivity, Si steel is hardened and degraded in press-workability.

Corrosion resistance is also one of the required properties of soft magnetic material, which is expected to be used in a special environment. But, electromagnetic soft iron and Si steel are poor in corrosion resistance. Corrosion resistance may be improved by formation of a Ni or chromate treatment layer, but such plating increases the cost of a product. The plating unfavorably degrades magnetic properties and also causes a deviation of magnetic properties due to irregularity in thickness of the plating layer.

Permalloy, especially permalloy C, is a material having an excellent A.C. magnetic property with high electric resistivity, but is very expensive. Soft ferrite is high in electric resistivity with less reduction of magnetic induction in a high-frequency zone not less than 10 kHz compared with metal material, but its magnetic flux density is less than that of metal material in a frequency zone not more than 5 kHz on the contrary.

Fe–Cr alloy has been heretofore used as yokes for a stepping motor due to is high electric resistivity, good corrosion resistance and cheapness compared with permalloy. However, in the case where conventional Fe–Cr alloy is used as a part in a magnetic circuit such as a magnetic sensor operated in a low-magnetic field less than 10 Oe with frequency of 100 Hz–5 kHz, sufficient output voltage necessary for accurate measurement is not obtained at a detecting terminal.

SUMMARY OF THE INVENTION

The present invention aims at providing a new cheap Fe–Cr soft magnetic material, excellent in properties as a magnetic sensor operated in a high-frequency low-magnetic field as well as corrosion resistance.

The newly proposed Fe–Cr soft magnetic material has electric resistivity not less than 50 $\mu\Omega\cdot$cm and a metallurgical structure composed of ferritic grains at a surface ratio not less than 95% with precipitates of 1 $\mu$m or less in particle size at a ratio less than $6\times10^5/mm^2$ in number.

The Fe–Cr soft magnetic material preferably has the composition consisting of C up to 0.05 mass %, N up to 0.05 mass %, Si up to 3.0 mass %, Mn up to 1.0 mass %, Ni up to 1.0 mass %, P up to 0.04 mass %, S up to 0.01 mass %, 5.0–20.0 mass % Cr, Al up to 4.0 mass %, 0–3 mass % Mo, 0–0.5 mass % Ti and the balance being Fe except inevitable impurities, under the conditions of (1) and (2).

$$4.3\times\%Cr+19.1\times\%Si+15.1\times\%Al+2.5\times\%Mo\geqq40.2 \quad (1)$$

$$64\times\%Si+35\times\%Cr+480\times\%Ti+25\times\%Mo+490\times\%Al\geqq221\times\%C+247\times\%N+40\times\%Mn+80\times\%Ni+460 \quad (2)$$

The soft magnetic material is manufactured by providing a Fe–Cr alloy having the specified composition, forming the Fe–Cr alloy to an objective shape, and heat-treating the formed Fe–Cr alloy in a zone between 900° C. and a temperature T (°C.) defined by the formula (3) in a vacuum or reducing atmosphere. The wording "soft magnetic material" means a material, which is not shaped to a magnetic part yet, in various forms of sheets, rods or wires in response to its application.

$$T(^\circ C.) = (64\times\%Si+35\times\%Cr+480\times\%Ti+490\times\%Al+25\times\%Mo+480)-(221\times\%C+247\times\%N+40\times\%Mn+80\times\%Ni) \quad (3)$$

DETAILED DESCRIPTION OF THE INVENTION

When a soft magnetic material is charged with an alternating magnetic field, energy losses occurs in the soft magnetic material.

Hysteresis loss, which is one of energy losses, is derived from suppression of movement of ferromagnetic domain walls due to interaction between the ferromagnetic domain walls and precipitates or lattice defects. In this sense, the hysteresis loss is reduced as a decrease of precipitates and lattice defects occurs. As for a Fe–Cr alloy, it is practically important to inhibit generation of fine precipitates and martensite grains.

Eddy current loss is also one of disadvantageous energy. The eddy current, i.e. a secondary current induced by change of magnetic intensity due to conductivity of the soft magnetic metal material, means energy loss caused by resistive loss. In order to reduce the eddy current loss, electric resistivity of the soft magnetic material shall be necessarily made greater so as to impede the eddy current.

In these points of view, the inventors have researched and examined effects of electric resistivity and a metallurgical structure as well as status of precipitates on magnitudes of hysteresis and eddy current losses, and also researched mechanism of high magnetic flux density in an alternating low-magnetic field. Although a conventional Fe–Cr soft magnetic material is necessarily heated at a temperature above its solid-soluble line (i.e. a boundary between a solid solution and a mixed phase) for dissolution of fine carbide particles in its matrix, the heating at an excessively higher temperature causes generation of γ-phase which is transformed to martensite grains during cooling. Therefore, it is necessary to specify precipitates which put harmful influences on soft magnetic property, and also to determine conditions of composition and heat-treatment capable of dissolving harmful precipitates in a matrix without generation of martensite phase.

Figure 1:
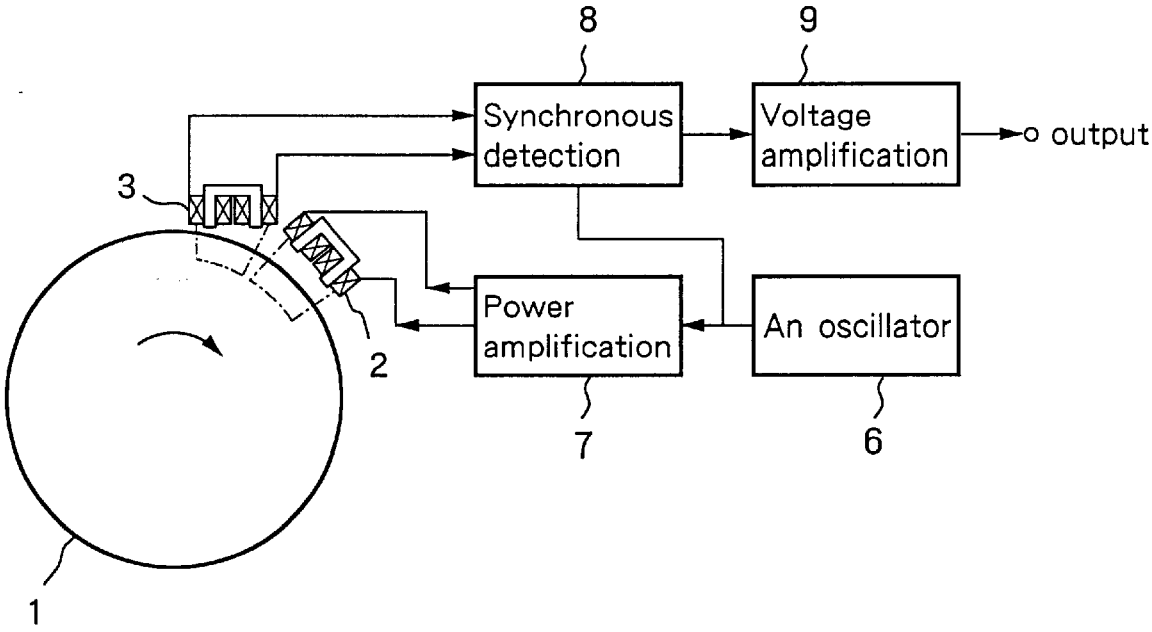
FIG. 1 is a schematic view for explaining a detecting circuit of a magnetostrictive torque sensor.
Figure 2:
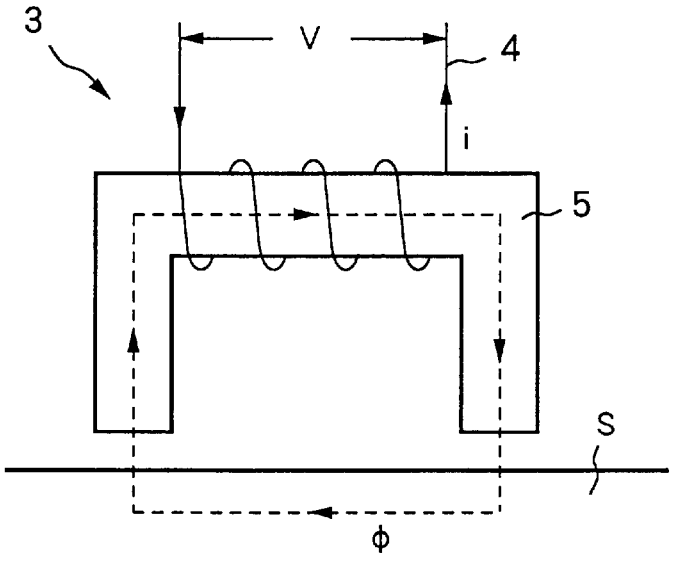
FIG. 2 is another schematic view for explaining a detecting coil installed in the detecting circuit.

A magnetostrictive torque sensor, one of magnetic sensors, has a detecting circuit shown in FIG. 1. A rotary shaft 1 is held at a position facing to an exciting coil 2 and a detecting coil 3. The detecting coil 3 has a magnetic circuit equipped with a soft magnetic part 5 on which a lead wire 4 is wound, as shown in FIG. 2. When a predetermined voltage V is charged between terminals to produce an electric current i, a magnetic flux line Φ is generated between the soft magnetic part 5 and a measuring object S. A change of magnetostriction caused by strain due to a torque is detected by the detecting coil 3 as variation of output voltage induced by the magnetic flux Φ generated by the exciting coil 2 driven by the oscillator 6 and power amplifier 7. A detection result is outputted through a synchronous detector 8 and an amplifier 9.

A soft magnetic part such as a core installed in the detecting circuit is manufactured by mechanically working a soft magnetic steel sheet or the like to a predetermined shape. The as-worked soft magnetic material is poor of magnetic permeability due to remaining of strains introduced by the mechanical working, resulting in poor magnetic induction. Such the harmful influences of strains are eliminated by heat-treatment for release of strains.

The inventors have researched effects of various factors on magnetic induction of a soft magnetic part as follows: Fe–Cr soft magnetic steels different from each other in electric resistivity are mechanically worked to an annular shape, annealed under various conditions and then offered to measurement of magnetic flux density. Magnetic flux density is measured by a B-H analyzer in an exciting low-magnetic field with oscillation frequency of 1 kHz and magnetic intensity of 1 Oe.

Figure 3:
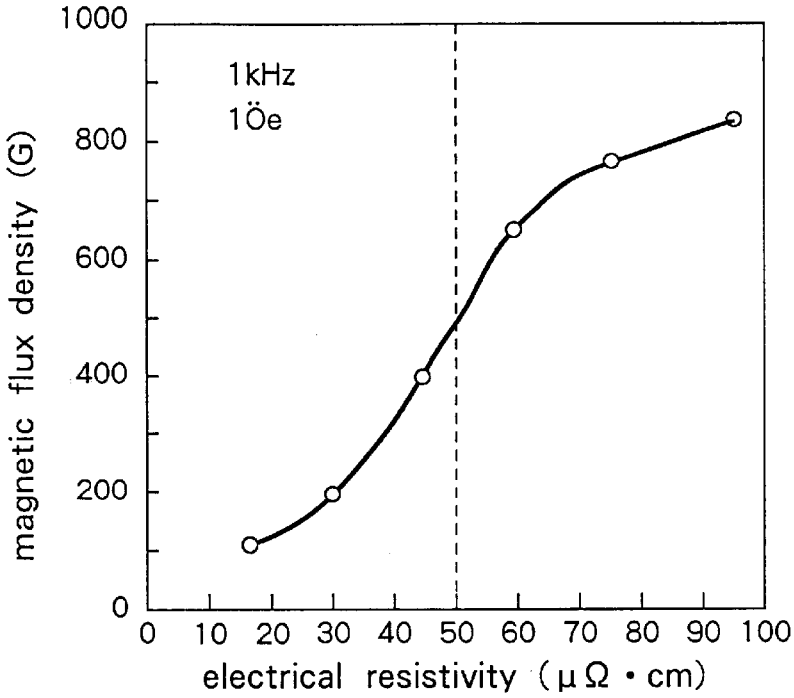
FIG. 3 is a graph showing an effect of electric resistivity on magnetic induction of a Fe–Cr soft magnetic material.

Measurement results are shown in FIG. 3. It is noted that a soft magnetic material is remarkably improved in magnetic induction at electric resistivity greater than 50 μΩ·cm. The inventors have further researched effects of compositions of soft magnetic materials, whose electric resistivity is greater than 50 μΩ·cm, on electric resistivity, and discovered that electric resistivity ρ of Fe–Cr alloy is defined by the undermentioned formula. Consequently, the above-mentioned formula (1) is determined in order to gain electric resistivity p greater than 50 μΩ·cm.

$$\rho(\mu\Omega\cdot cm)=4.3\%Cr+19.1\%Si+15.1\%Al+2.5\%Mo+9.8$$

However, soft magnetic parts made of the same Fe–Cr alloy have the feature that magnetic induction is significantly deviated in response to annealing conditions, for use in a magnetic circuit operated in a low-magnetic field of 1 Oe or so. The inventors have investigated effects of metallurgical structures on magnetic induction for elucidation of causes leading to deviation of magnetic induction, by observing the metallurgical structure of an annealed soft magnetic material. As a result, the inventors have discovered that the metallurgical structure, which involves martensite grains or fine precipitates in a ferrite single phase free from martensite grains, is very poor of magnetic induction (i.e. poor sensor property), even if the soft magnetic part is made of the same Fe–Cr alloy.

Figure 5:
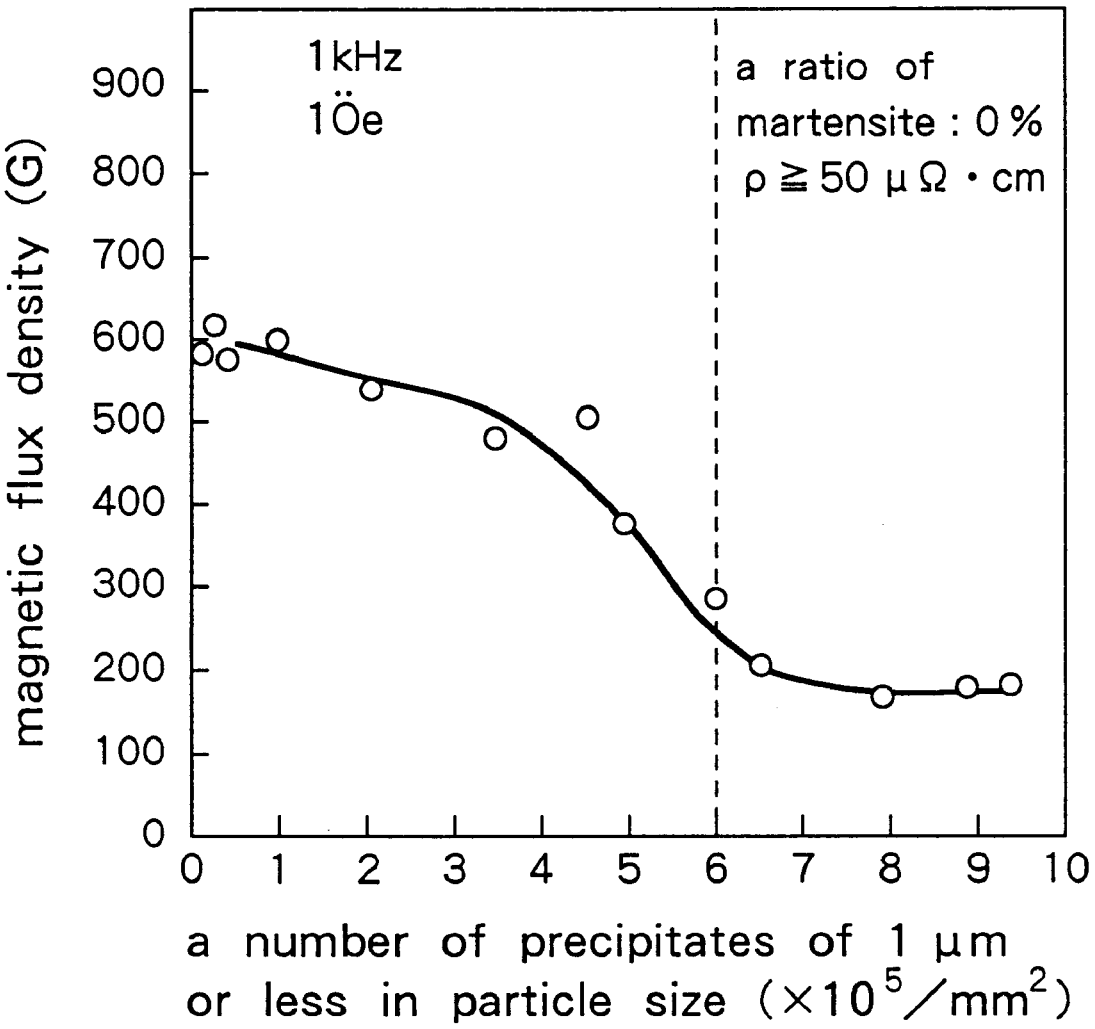
FIG. 5 is a graph showing an effect of a number of fine precipitates on magnetic induction of a Fe–Cr soft magnetic material.

The unfavorable effect of martensite grains on magnetic induction is apparently noted in the Fe–Cr alloy which involves martensite grains at a ratio of 5 vol. % or more. Precipitates of 1 μm or bigger in particle size do not substantially affect magnetic induction, but magnetic induction is affected by fine precipitates less than 1 μm in particle size. Magnetic induction is worsened as precipitates increase in number. In particular, a distribution of fine precipitates less than 1 μm at a ratio of $6\times10^5/mm^2$ in number causes a significant degradation of magnetic induction, as shown in FIG. 5.

These results prove that a Fe–Cr alloy, which is useful as a soft magnetic part installed in a magnetic circuit such as a magnetic sensor operated in a high-frequency exciting field, shall have electric resistivity not less than 50 μΩ·cm and an as-annealed metallurgical structure involving martensite grains not more than 5 vol. % with precipitates of 1 μm or less in particle size at a ratio not more than $6\times10^5/mm^2$.

Fine precipitates of 1 μm or less in particle size can be remarkably reduced by heating a Fe–Cr alloy at a temperature higher than 900° C. The effect of heat-treatment on decrease of fine precipitates is distinctly noted by soaking the Fe–Cr alloy preferably for 30 minutes or longer. However, an excessively high soaking temperature means over-heating of the Fe–Cr alloy in a γ-zone, resulting in generation of martensite grains during cooling.

Such a kind of steel, which causes γ-phase at a heating temperature below 900° C., cannot be reformed to a metallurgical structure composed of a ferrite single phase effective for improvement of magnetic induction with suppression of fine precipitates. Accounting practical accuracy of temperature control in a conventional oven, a temperature range of heat-treatment for generation of a single-ferrite matrix involving less fine precipitates without martensite grains shall have allowance of at least ±20° C. (ideally ±50° C.) with respect to a predetermined temperature.

An initiating temperature T (°C.) for generation of γ-phase is represented by the above-mentioned formula (3) according to the inventors' researches on effects of alloying elements. On the other hand, the initiating temperature T shall be not lower than 900° C. for inhibiting generation both of martensite grains and fine precipitates with allowance of at least ±20° C. accounting accuracy of temperature control in a conventional oven.

Therefore, the initiating temperature T (°C.) is determined at a temperature not lower than 940° C. The above-mentioned formula (2) is obtained by inserting the formula (3) to the relationship of T≧940° C. Furthermore, a temperature for heat-treatment is preferably adjusted to 940° C. or higher in order to promote growth of crystal grains without generation of martensite phase for improvement of magnetic property. An ideal temperature T is 980° C. at lowest.

Generation of a metallurgical structure composed of a single-ferrite phase is promoted by adding a ferrite-stabilizing element(s) such as Si to a Fe–Cr alloy for rising of an initiating temperature T. However, excessive addition of the ferrite-stabilizing element(s) causes degradation of rollability and press-workability as well as occurrence of surface defects.

Figure 4:
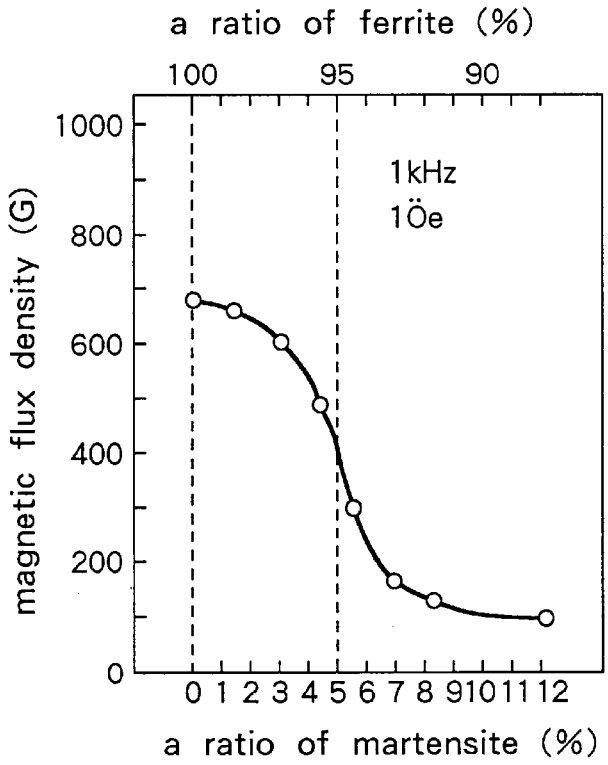
FIG. 4 is a graph showing an effect of a ratio of martensite grains on magnetic induction of a Fe–Cr soft magnetic material.

Reduction of martensite grains at a ratio not more than 5 vol. % effectively suppresses degradation of magnetic induction, as shown in FIG. 4. Reduction of martensite grains is attained by enlarging a difference between a ferritizing intensity (represented by 11.5×%Si+11.5×%Cr+49×%Ti+12×%Mo+52×%Al) and an austenitizing intensity (represented by 420×%C+470×%N+7×%Mn+23×%Ni). Such the difference more than 124 makes it possible to absolutely suppress generation of martensite grains, since a Fe–Cr alloy can be heated up to 1030° C. or so without generation of γ-phase.

The initiating temperature T for generation of γ-phase becomes higher with an increase in the difference between the ferritizing and austenitizing intensities, so as to promote the production of a metallurgical structure composed of a single-ferrite phase. However, an increase in the difference requires a significant addition of ferritizing elements to the Fe–Cr alloy, resulting in the degradation of rollability and press-workability as well as an occurrence of surface defects. As a consequence, the composition of the newly proposed Fe–Cr alloy is preferably determined as follows:

C is an element harmful to the magnetic property of a Fe–Cr soft magnetic material, since it accelerates generation of martensite grains and precipitation of carbides. The Fe–Cr alloy is harder as the C content increases, resulting in poor press-workability. These harmful influences are suppressed by controlling C content to not more than 0.05 mass %.

N is also harmful element, since it accelerates generation of martensite grains and worsens press-workability of the Fe–Cr alloy due to increase of hardness. In this sense, an upper limit of N content is controlled at 0.05 mass %.

Si up to 3.0 Mass %

Si is an alloying element effective for increasing electric resistivity and magnetic induction in an alternating magnetic field. The additive Si favorably suppresses generation of martensite, which puts harmful influences on soft magnetic property. However, excessive addition of Si causes an increase in hardness and degradation of press-workability. In this sense, an upper limit of Si content is determined at 3.0 mass %.

Mn is an impurity element, which is included in a Fe–Cr alloy melt from raw materials such as scrap found in an alloy-melting step, and accelerates generation of martensite. Therefore, an upper limit of Mn content is determined at 1.0 mass %.

Ni is also an impurity element, which is included in a Fe–Cr alloy melt from raw materials such as scrap found in an alloy-melting step, and accelerates generation of martensite. Therefore, an upper limit of Ni content is determined at 1.0 mass %.

P is included as phosphides, which puts harmful influences on soft magnetic property, so an upper limit of P content is determined at 0.04 mass %.

S up to 0.01 Mass %

S is included as sulfides, which puts harmful influences on soft magnetic property, so an upper limit of S content is determined at 0.01 mass %.

5.0–20.0 Mass % Cr

Cr is an alloying element, which suppresses generation of martensite, increases electric resistivity of a Fe–Cr alloy, improves magnetic induction in an alternating magnetic field the same as Si, and also improves corrosion resistance. These effects are apparent at a Cr content of more than 5.0 mass % (preferably 10 mass %). However, excessive additions of Cr above 20.0 mass % degrade magnetic induction and press-workability of the Fe–Cr alloy due to increased hardness.

Al is an alloying element, which remarkably increases electric resistivity and magnetic induction in an alternating magnetic field the same as Si and Cr. However, excessive addition of Al causes an occurrence of surface defects originated in type-$A_1$ inclusions, so that an upper limit of Al content is determined at 4.0 mass %.

Mo is an optional alloying element, which suppresses generation of martensite, increases electric resistivity, improves magnetic induction in an alternating magnetic field and also improves corrosion resistance as the same as Cr. However, excessive addition of Mo above 3 mass % significantly hardens a Fe–Cr alloy and degrades its press-workability.

0–0.5 Mass % Ti

Ti is an optional alloying element, which suppresses generation of martensite the same as Cr and Mo, but causes occurrence of surface defects originated in titanyl inclusions. In this sense, an upper limit of Ti content is determined at 0.5 mass %.

EXAMPLE

Several Fe–Cr alloys having compositions shown in Table 1 were melted in a 30 kg high-frequency furnace in a vacuum atmosphere. A Fe–Cr soft magnetic alloy sheet of 2.0 mm in thickness was manufactured from each alloy by casting, forging, hot-rolling, cold-rolling, finish-annealing and then pickling.

TABLE 1

Fe—Cr Alloys Used In Example 1

| Alloy | Alloying Elements (mass %) | | | | | | | | | | | A value | A value | |
|---|---|---|---|---|---|---|---|---|---|---|---|---|---|---|
| No. | C | Si | Mn | P | S | Ni | Cr | Ti | Al | Mo | N | A | B | Note |
| A1 | 0.011 | 0.62 | 0.25 | 0.031 | 0.002 | 0.21 | 11.3 | 0.22 | 0.03 | 0.02 | 0.008 | 60.9 | 525 | Inventive |
| A2 | 0.002 | 0.65 | 0.23 | 0.033 | 0.001 | 0.14 | 12.5 | 0.00 | 0.02 | 0.01 | 0.002 | 66.5 | 468 | Examples |
| A3 | 0.008 | 0.57 | 0.25 | 0.031 | 0.001 | 0.15 | 11.6 | 0.19 | 0.02 | 0.02 | 0.012 | 61.1 | 517 | |
| A4 | 0.008 | 0.58 | 0.24 | 0.032 | 0.002 | 0.20 | 10.9 | 0.20 | 0.02 | 0.01 | 0.011 | 58.3 | 495 | |

TABLE 1-continued

Fe—Cr Alloys Used In Example 1

| Alloy | Alloying Elements (mass %) | | | | | | | | | | | A value | A value | |
|---|---|---|---|---|---|---|---|---|---|---|---|---|---|---|
| No. | C | Si | Mn | P | S | Ni | Cr | Ti | Al | Mo | N | A | B | Note |
| A5 | 0.012 | 1.80 | 0.27 | 0.030 | 0.002 | 0.21 | 8.9 | 0.18 | 0.10 | 1.02 | 0.010 | 76.7 | 555 | |
| A6 | 0.013 | 0.61 | 0.45 | 0.029 | 0.001 | 0.20 | 16.5 | 0.05 | 0.01 | 0.02 | 0.017 | 82.8 | 605 | |
| A7 | 0.012 | 0.03 | 0.3 | 0.029 | 0.002 | 0.16 | 13.1 | 0.00 | 0.59 | 0.01 | 0.015 | 65.9 | 719 | |
| A8 | 0.008 | 0.00 | 0.3 | 0.029 | 0.002 | 0.16 | 11.2 | 0.01 | 2.45 | 0.01 | 0.015 | 85.2 | 1567 | |
| A9 | 0.009 | 0.27 | 0.45 | 0.028 | 0.001 | 0.40 | 18.2 | 0.14 | 2.90 | 0.02 | 0.013 | 127.3 | 2088 | |
| B1 | 0.011 | 0.50 | 0.63 | 0.031 | 0.002 | 0.16 | 11.8 | 0.00 | 0.02 | 0.02 | 0.012 | 60.6 | 412 | Comparative |
| B2 | 0.035 | 0.25 | 0.88 | 0.032 | 0.002 | 0.45 | 10.6 | 0.20 | 0.02 | 0.01 | 0.017 | 50.7 | 410 | Examples |
| B3 | 0.005 | 0.23 | 0.21 | 0.031 | 0.001 | 0.11 | 7.8 | 0.37 | 0.01 | 0.01 | 0.005 | 38.1 | 521 | |

A value A : 4.3 × % Cr + 19.1 × % Si + 15.1 × % A1 + 2.5 × % MO
A value B : (64 × % Si + 35 × % Cr + 480 × % Ti + 490 × % Al + 25 × % Mo) − (221 × % C + 40 × % Mn + 80 × % Ni + 247 × % N)
The underlined figures are out of the scope of the present invention.

Test pieces were cut off each Fe–Cr soft magnetic alloy sheet.

After an annular test piece of 45 mm in outer diameter and 33 mm in inner diameter was annealed under conditions shown in Table 2, its magnetic flux density B was measured by a B-H analyzer in a magnetic field of 1 Oe with frequency of 1 kHz.

Another test piece of 30 mm×30 mm in size was etched in a fluoronitric acid-glycerin liquor ($HF:HNO_3$:glycerin= 2:1:2) and then subjected to a point counting method using an optical microscope for measurement of martensite.

The same test piece was etched by a SPEED (Selective Potentiostatic Etching by Electrolytic Dissolution) method and then observed by a scanning microscope. The number of fine precipitates of 1 $\mu$m or less in particle size, displayed on a monitor screen, was counted to calculate a number of fine precipitates per 1 $mm^2$. Furthermore, a test piece of 5 mm in width and 150 mm in length was subjected to Wheatstone bridge method to measure its electric resistivity.

On the other hand, the soft magnetic Fe–Cr alloy sheet was press-worked to cores of exciting and detecting coils, and then annealed under the same conditions as the annular magnet. The cores were inspected to detect presence or absence of cracks. Press-workability of the Fe–Cr alloy sheet was evaluated in response to occurrence of cracking.

Each core was installed in a magnetostrictive torque sensor (shown in FIG. 1). An output voltage of a detecting coil corresponding to an input torque was measured in a magnetic field of 1 Oe with oscillation frequency of 1 kHz applied to an exciting coil. The measured voltage was compared with a standard value (100) representing an output voltage necessary for a sensor, and sensor property was evaluated as good (○) at a value not less than 100, as a little, i.e., moderately defective (Δ) at a value 100–80 or as defective (X) at a value less than 80.

Test results are shown together with annealing conditions in Table 2.

The results prove that test pieces Nos. 1–9, whose electric resistivity, a ratio of martensite and a number of fine precipitates were controlled according to the present invention, produced magnetic flux density not less than 500 G and higher output voltage. Therefore, the Fe–Cr alloy sheets Nos. 1–9 are useful as cores of a torque sensor having an improved sensor property.

On the other hand, the Fe–Cr alloy sheet No. B1 had magnetic induction significantly worsened due to its metallurgical structure wherein fine precipitates of 1 $\mu$m or less in particle size are excessively distributed at a ratio above $6\times10^5/mm^2$ in number. As a result, a core made of the alloy sheet No. B1 exhibited an inferior sensor property.

The test piece No. 11, which was made of the Fe–Cr alloy sheet having the same composition but annealed at a lower temperature in a magnetic field, had magnetic induction significantly worsened due to its metallurgical structure having an excessive distribution of fine precipitates of 1 $\mu$m or less in particle size therein. A core made of the alloy sheet No. 11 was also inferior in sensor property due to such degradation of magnetic induction. The test piece No. 12, which was annealed at an excessively high temperature on the contrary, involves a lot of martensite grains in an annealed state. Therefore, the core made of the alloy sheet No. 12 had its magnetic induction significantly worsened due to generation of martensite, resulting in poor sensor property.

TABLE 2

Effects Of Annealing Conditions, Electric resistivity And Metallurgical Structure On Press-Workability, Magnetic Property And Sensor Property

| Sample No. | Alloy No. | A value T | Annealing temp. (° C.) | Annealing hrs. | Electric resistivity ($\mu\Omega$.cm) | A ratio of ferrite phase (%) | A number of fine precipitates ($\times10^5/mm^2$) | Magnetic flux density B (G) | Sensor property | Note |
|---|---|---|---|---|---|---|---|---|---|---|
| 1 | A1 | 1005 | 980 | 2 | 61 | 100 | 0.6 | 570 | ○ | Inventive |
| 2 | A2 | 948 | 940 | 2 | 65 | 100 | 0.2 | 870 | ○ | Examples |
| 3 | A3 | 997 | 980 | 2 | 62 | 100 | 0.4 | 660 | ○ | |
| 4 | A4 | 975 | 960 | 2 | 59 | 100 | 0.4 | 580 | ○ | |

TABLE 2-continued

Effects Of Annealing Conditions, Electric resistivity And Metallurgical Structure On Press-Workability, Magnetic Property And Sensor Property

| Sample No. | Alloy No. | A value T | Annealing temp. (° C.) | Annealing hrs. | Electric resistivity (μΩ.cm) | A ratio of ferrite phase (%) | A number of fine precipitates ($\times 10^5/mm^2$) | Magnetic flux density B (G) | Sensor property | Note |
|---|---|---|---|---|---|---|---|---|---|---|
| 5 | A5 | 1035 | 980 | 2 | 75 | 100 | 0.3 | 740 | ○ | |
| 6 | A6 | 1085 | 980 | 2 | 83 | 100 | 0.5 | 550 | ○ | |
| 7 | A7 | 1199 | 1060 | 2 | 65 | 100 | 0.2 | 770 | ○ | |
| 8 | A8 | 2047 | 1000 | 2 | 121 | 100 | 2.5 | 870 | ○ | |
| 9 | A9 | 2568 | 1000 | 2 | 99 | 100 | 0.9 | 840 | ○ | |
| 10 | B1 | 892 | 880 | 2 | 61 | 100 | 7.4 | 210 | X | Comparative |
| 11 | B2 | 890 | 940 | 2 | 51 | 92 | 0.7 | 210 | X | Examples |
| 12 | B3 | 1001 | 980 | 2 | 47 | 100 | 0.2 | 380 | Δ | |
| 13 | A1 | 1005 | 880 | 2 | 61 | 100 | 9.5 | 180 | X | |
| 14 | A1 | 1005 | 1060 | 2 | 61 | 88 | 0.4 | 220 | X | |

T = (64 × % Si + 35 × % Cr + 480 × % Ti + 490 × % A1 + 25 × % Mo + 480) − (221 × %C + 40 × % Mn + 80 × % Ni + 247 × % N)

○:good, Δ:a little defective, X:defective

The underlined figures are out of the scope of the present invention.

The soft magnetic material according to the present invention as above described is made of a Fe–Cr alloy having electric resistivity not less than 50 μΩ·cm and a metallurgical structure which involves less martensite grains and suppresses distribution of fine precipitates. Due to the high resistivity and the specified metallurgical structure, the soft magnetic material produces great magnetic induction, resulting in excellent sensor property, even in a low-magnetic field excited with high frequency. As a result, a sensor having good measurement accuracy is obtained by installing the soft magnetic material as a core or yoke in a magnetic circuit such as an electromagnetic induction sensor or a mechanical quantity sensor.

What is claimed is:

1. A Fe–Cr soft magnetic material, which has electric resistivity not less than 50 μΩ·cm and a metallurgical structure composed of ferritic grains at a volume ratio not less than 95% with precipitates of 1 μm or less in particle size at a ratio not more than $6\times10^5/mm^2$ in number.

2. The Fe–Cr soft magnetic material according to claim 1, which consists of C up to 0.05 mass %, N up to 0.05 mass %, Si up to 3.0 mass %, Mn up to 1.0 mass %, Ni up to 1.0 mass %, P up to 0.04 mass %, S up to 0.01 mass %, 5.0–20.0 mass % Cr, Al up to 4.0 mass %, 0–3 mass % Mo, 0–0.5 mass % Ti and the balance being Fe except inevitable impurities, under conditions of the formulas (1) and (2):

$$4.3\times\%Cr+19.1\times\%Si+15.1\times\%Al+2.5\times\%Mo\geqq40.2 \quad (1)$$

$$64\times\%Si+\%Cr+480\times\%Ti+25\times\%Mo+490\times\%Al\geqq221\times\%C+247\times\%N+40\times\%Mn+80\times\%Ni+460 \quad (2).$$

* * * * *

UNITED STATES PATENT AND TRADEMARK OFFICE

CERTIFICATE OF CORRECTION

PATENT NO. : 6,599,376 B2 
DATED : July 29, 2003
INVENTOR(S) : Hiroshi Morikawa et al.

It is certified that error appears in the above-identified patent and that said Letters Patent is hereby corrected as shown below:

Column 5,
Line 35, after "follows:" insert -- [new paragraph] C up to 0.05 mass % --.
Line 41, after "%." insert -- [new paragraph] N up to 0.05 mass % --.
Line 54, after "%." insert -- [new paragraph] Mn up to 1.0 mass % --.

Column 6,
Line 5, after "%." insert -- [new paragraph] Ni up to 1.0 mass % --.
Line 10, after "mass %." insert -- [new paragraph] P up to 0.04 mass % --.
Line 27, after "hardness." insert -- [new paragraph] AL up to 4.0 mass % --.
Line 33, after "%." insert -- [new paragraph] 0-3 mass % MO --.

Column 10,
Line 35, "64x%Si+%Cr+480x%Ti+25x%Mo+" should read
-- 64x%Si+35x%Cr+480x%Ti+25x%Mo+ --.

Signed and Sealed this

Seventeenth Day of February, 2004

JON W. DUDAS
*Acting Director of the United States Patent and Trademark Office*